United States Patent [19]

Fleischer et al.

[11] 4,020,534

[45] May 3, 1977

[54] APPARATUS FOR MONITORING STEMS OF ELECTRICAL LIGHT SOURCES DURING MANUFACTURE

[75] Inventors: Bertalan Fleischer; Ottó Gaál; Sándor Lengyel; Gyula Pioker, all of Budapest, Hungary

[73] Assignee: Egyesült Izzólámpa És. Villamossági Resveny tarsasag, Budapest, Hungary

[22] Filed: Oct. 6, 1975

[21] Appl. No.: 619,653

[52] U.S. Cl. ..... 29/25.11; 29/25.19

[51] Int. Cl.[2] ..... H01J 9/00

[58] Field of Search ..... 29/593, 25.11, 25.13, 29/25.19

[56] References Cited

UNITED STATES PATENTS 3,204,329 9/1965 Sweeney ..... 29/593

3,869,772 3/1975 Latassa et al. ..... 29/25.13

*Primary Examiner*—Richard B. Lazarus

[57] ABSTRACT

The invention concerns monitoring of stems of electrical light sources during manufacture. Each stem is positioned or passes between two nozzles blowing compressed air in a direction where a hole in the pinch should be. The parallel axes of symmetry of the nozzles are arranged in a common plane, to intercept at an angle of or less than 180°, there being an angle of at most 85° between the common plane and a reference plane that is perpendicular to the axis of symmetry of the stem. A flow-sensing device is disposed above the nozzles. Flow of compressed air detected by the device is indicative of stem quality, that is the presence of a hole on at least one side of the pinch and, is thus used to separate satisfactory stems from unsatisfactory ones.

4 Claims, 3 Drawing Figures

Figure 1:
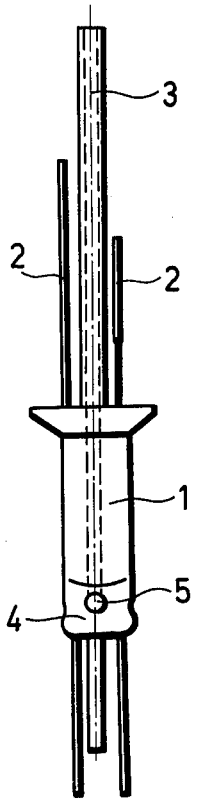

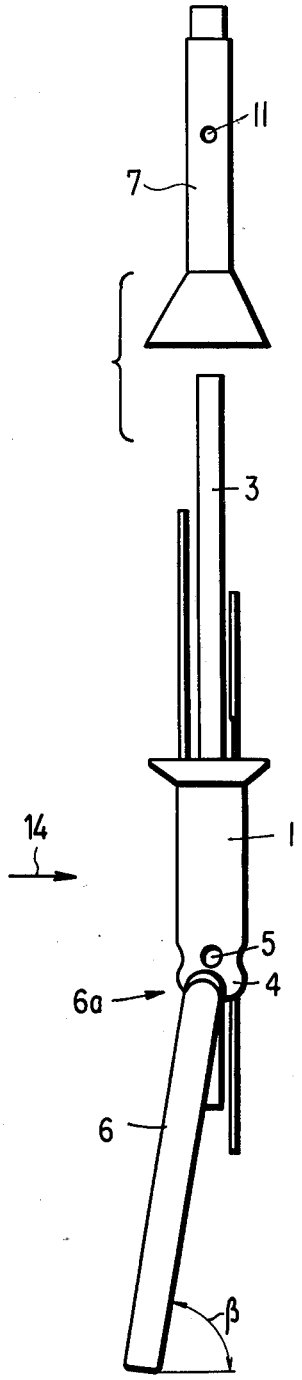
Fig. 2/b
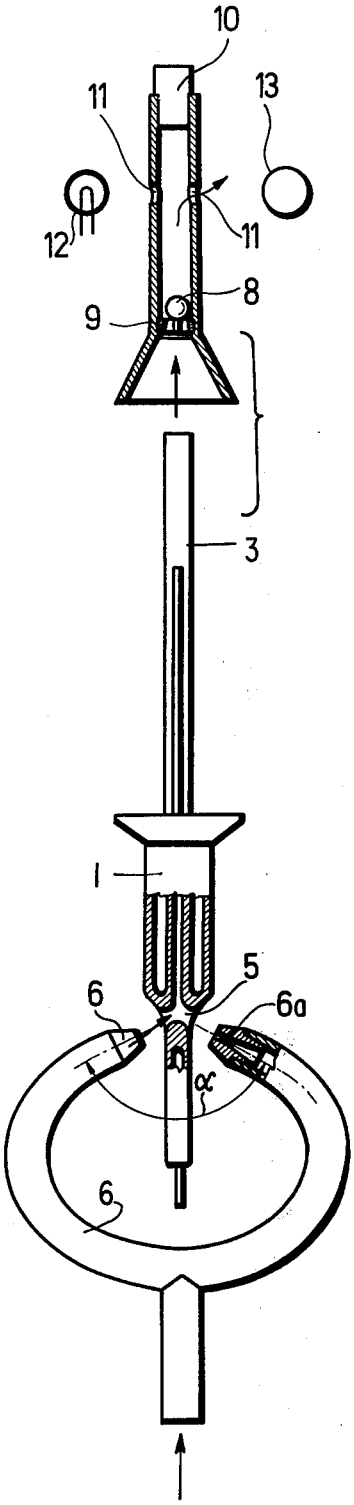
Fig. 2/a

APPARATUS FOR MONITORING STEMS OF ELECTRICAL LIGHT SOURCES DURING MANUFACTURE

This invention concerns a method and an apparatus for monitoring the opening that connects the inner gas space of an electrical source of light with the exhaust tube of the latter, such as an incandescent lamp or a fluorescent tube. More particularly, this invention serves to examine the permeability to gas flow of the opening connecting the exhaust tube, before it is tipped off, with the internal gas space (or vacuum space) of the light source.

Generally the first manufacturing step is making incandescent lamps, fluorescent tubes, and generally electrical source of light, is the fabrication of the stems. A conventional stem is a semi-finished product comprising a flare tube, two electrodes (lead-in wires) and an exhaust tube made of glass or the like and united by melting.

In the manufacture of the stem it is an important operation to produce by blowing at least one exhaust hole at a flattened portion of the flare tube, known as the pinch, which hole becomes a continuation of the bore of the exhaust tube. The result of blowing out is a hole which may form on either side of the pinch, but the case may also arise where a respective hole is formed on both sides of the pinch.

A stem is classified as satisfactory if there is a hole on at least one side of the pinch.

If no such hole is formed, then in a subsequent exhausting operation no suction and filling can or should be produced, i.e. the lamp or fluorescent tube becomes a reject. This is why it is important to monitor the operation, to eject faulty stems and, in the event of a continuously arising blow-out fault, quickly to eliminate that fault.

In hitherto known and constructed automatic light-source making machinery no blow-out monitoring and classifying apparatus has been provided, and the present invention seeks to overcome this drawback.

According therefore to the present invention, there is provided an apparatus for the automatic monitoring of stems for electrical light sources made on continuously or intermittently operated automatic stem-making machinery, comprising two nozzles connectable to a source of flowing gas, the axes of symmetry of which intercept in a common plane at a maximum angle of 180°, and there being an angle of at most 85° between the common plane and a plane perpendicular to the axis of symmetry of the stem being monitored, and a flow-sensing device disposed above, separated from the nozzles, and connected to operate as a control device.

In another aspect of the invention, there is provided a method of monitoring the stems of electrical light sources, comprising passing each stem between two nozzles which blow a gas, the axes of symmetry of the nozzles being arranged so that they intercept at an angle of 180° or less, as explained above, and the common plane again defines an angle of at most 85° with the axis of symmetry plane of the stem, disposing a flow-sensing device above and spaced from the nozzle so that flow of gas sensed by the device is indicative of the quality of the stem being monitored, and utilizing the indication thus provided to separate satisfactory stems from unsatisfactory ones.

The invention is described, by way of example, with reference to the accompanying drawing, wherein:

FIG. 1 is a schematic view of a known stem of an incandescent lamp; and

FIG. 2*a* and 2*b* are two schematic, part-sectional, part-elevational views, taken at right angles to each other, of the most important parts of the apparatus according to the invention.

Referring to FIG. 1, there is shown a known stem for an electrical incandescent lamp, consisting of a flare tube 1, lead-in wires 2, and an exhaust tube 3, the flare tube 1 being formed with a pinch 4 in which a hole 5 by or two such holes has or have been blown, as the case may be.

The monitoring apparatus according to the invention and illustrated in FIGS. 2a and 2b operates by blowing compressed air at both sides of the pinch 4 by means of nozzles 6a at ends of tubes 6. In the case of a satisfactory stem the compressed air penetrates into the hole or holes 5 and is discharged at the upper end of the exhaust tube 3 to pass to a flow-sensing device 7 which serves to indicate that the stem is satisfactory as regards blowing-out, meeting several requirements as will be outlined hereunder.

The blowing-in takes place through the two nozzles 6 because of the possibility of the hole or holes. However, in our experience the arrangement of these two nozzles 6 must be quite special. The case must not be allowed to arise where, after the meeting of the two air streams flowing out of the nozzles, the resultant air stream erroneously actuates the flow-sensing device 7, such as when, in given cases, the hole or holes 5 did not form, or where no stem to be monitored is present at all. On the contrary: for the operation of the flow-sensing device 7 the actual presence of a stem with at least one properly formed hole 5 is necessary.

In this invention, the nozzles 6 are so arranged that their axes (illustrated in chain lines in FIGS. 2*a* and 2*b*) are parallel, lie in a plane, and include an angle $\alpha$ of 180° or less between each other. Moreover, the plane defined by the axes of the two nozzles, representing intersecting straight lines, define an angle $\beta$ which deviates from 90° with another, usually horizontal reference plane. Finally, the point of intersection of the axes at the height of the hole 5 should coincide with the axis of symmetry of the stem. These three conditions ensure that even in the event of hole formation on both sides there will be an air stream rising in the exhaust tube 3 which will provide an indication, or in other words in the absence of hole(s) or of a stem, no air can reach the flow-sensing device 7. With nozzles constructed on the basis of this discovery it has been possible to classify continuously moving stems in the course of their motion from the point of view of blowing-out by means of the device 7 arranged at the upper end of the exhaust tube 3.

As can be seen, the flow-sensing device 7 is disposed at an appropriate height above the two nozzles 6 and consists, in essence, of a hollow tube widened into a funnel at the lower end, as viewed.

Within the tube 7 a ball 8 (or any other body with a shape favourable from the point of fluid dynamics) is arranged to move freely between at least one perforated abutment 9 and a stopper 10 closing the upper end of the tube 7. A source of light 12 is provided to illuminate a light-sensitive device or detector 13 via bores 11 formed in the tube 7.

In operation, the finished stems removed from a continuously operating automatic stem-making machine (not shown) pass in the direction of an arrow 14 between the nozzles 6, while the air streaming out from the latter passes into the exhaust tube 3 through the blown-out hole (holes) 5, and from there into tube 7. It will be understood by those skilled in the art that the air stream passing from the top of the exhaust tube 3 into the bottom funnel of the device 7 will pass through the perforation or hole in the abutment(s) 9 on which the ball 8 rests. The latter will rise within the tube 7 up to or slightly above the level of the side bores 11, the only place where the air can be allowed to escape from the flow-sensing device. By this action, the line of sight between the source 12 and the light detector 13 is at least momentarily interrupted, thereby giving the required output signal that indicates that the just tested stem is satisfactory: it has at least one hole 5 in its pitch 4. The output signal from the light detector 13 is passed to conventional circuitry (not shown) arranged to inhibit the operation of an ejector, also not shown, the just tested unit being suitable for the subsequent manufacturing steps.

If however the stem is faulty, the light detecting device 13 does not inhibit the operation of the ejector which thus operates at a point in time determined by a non-illustrated synchronous signalling device and removes the faulty stem from the machine.

It is a great advantage of the described exemplary embodiment of the invention that is not only solves a problem which has hitherto not been sufficiently recognized but which causes considerable spoilage, but also reliably eliminates the defects originating therefrom even in the case of manufacturing of electrical light sources at greater speeds than hitherto.

We claim as our invention:

1. An apparatus for monitoring stems of electrical light sources made on automatic stem-making machinery, each stem having a central, hollow flare tube, an exhaust tube extending therefrom in substantially axial alignment, and a pinch in a portion of the flare tube, remote from the exhaust tube, which pinch is to be provided with a hole on at least one side, the stem having an axis of symmetry; the apparatus comprising: two nozzles disposed adjacent a stem monitoring position at which all stems in the manufacturing process are made to pass; means to pass said stems to said monitoring position and between said nozzles, said nozzles being connected to a source of pressurized fluid and having respective axes of symmetry that define among themselves a first plane, said nozzles being so disposed relative to each other and to said monitoring position that their axes of symmetry intercept at a first angle in said first plane of about 180° ; a second, substantially horizontal reference plane which is perpendicular to the stem axis of symmetry, defining with the first plane a second angle not exceeding 85°; and a flow-sensing device separate from said nozzles, disposed above the upper free end of the exhaust tube and along the stem axis of symmetry, operable to receive fluid flow from said fluid source via at least one nozzle, the hole, and said exhaust tube only in the event that at least one hole is present in the pinch at said monitoring position.

2. The apparatus as defined in claim 1, wherein said flow-sensing device includes a hollow tube positioned above the upper free end of the exhaust tube, two spaced-apart abutments within said tube, a freely movable element disposed between and above said abutments, displaceable against gravity in response to the fluid flow reaching said tube by the intermediary of the at least one hole in the pinch when properly made, a light source and a light detector positioned on respective sides of the path of movement of said element, thereby to control extraneous equipment for separating satisfactory and unsatisfactory stems, that is those with and without the at least one hole, respectively.

3. A method of monitoring stems of electrical light sources made on automatic stem-making machinery, each stem having a flare tube, an exhaust tube extending therefrom, and a pinch in the flare tube, which pinch is to be provided with a hole on at least one side, the stem having an axis of symmetry; the method comprising the steps of: passing the stems at a monitoring position between two nozzles connected to a source of pressurized fluid and having respective axes of symmetry that define among themselves a first plane, the nozzles being so disposed relative to each other and to the monitoring position that their axes of symmetry intercept at a first angle in said first plane of about 180°; a second, substantially horizontal plane which is perpendicular to the stem axis of symmetry defining with the first plane a second angle not exceeding 85°; sensing the presence of fluid flow from the fluid source via at least one nozzle, the hole, and said exhaust tube, at a position separate from the nozzles, above the upper free end of the exhaust tube and along the stem axis of symmetry, only in the event that at least one hole is present in the pinch at the monitoring position; and utilizing the sensed fluid flow to separate satisfactory and unsatisfactory stems, that is those with and without the at least one hole, respectively.

4. The apparatus as defined in claim 2, wherein said hollow tube of the flow-sensing device is closed at the top, and has in its side at least one bore through which the fluid flow can escape, said light source and said detector being positioned substantially at the level of said at least one bore.

* * * * *